United States Patent [19]

Akiyama et al.

[11] Patent Number: 4,551,711

[45] Date of Patent: Nov. 5, 1985

[54] INFRARED-TYPE INTRUSION DETECTOR

[75] Inventors: Shoichi Akiyama; Mikio Kondo, both of Tsu, Japan

[73] Assignee: Matsushita Electric Works, Ltd., Osaka, Japan

[21] Appl. No.: 575,405

[22] Filed: Jan. 30, 1984

[30] Foreign Application Priority Data

Aug. 26, 1983 [JP] Japan ..... 58-156995

[51] Int. Cl.[4] ..... G08B 13/18

[52] U.S. Cl. ..... 340/567; 250/342; 250/353

[58] Field of Search ..... 340/565, 567; 250/342, 250/353

[56] References Cited

U.S. PATENT DOCUMENTS

| | | | |
|---|---|---|---|
| 3,524,180 | 8/1970 | Cruse | 340/567 X |
| 4,263,585 | 4/1981 | Schaefer | 340/567 |
| 4,268,752 | 5/1981 | Herwig et al. | 250/342 X |
| 4,275,303 | 6/1981 | Mudge | 250/353 X |
| 4,342,987 | 8/1982 | Rossin | 340/565 X |
| 4,429,224 | 1/1984 | Wagli et al. | 250/353 |
| 4,442,359 | 4/1984 | Lederer | 340/567 X |
| 4,451,734 | 5/1984 | St. Jean et al. | 250/353 X |

*Primary Examiner*—James L. Rowland
*Assistant Examiner*—Brian R. Tumm

[57] ABSTRACT

An infrared-type intrusion detector for monitoring the presence of a person is disclosed. The detector has a plurality of concave reflector segments for defining separate fields of view. Infrared radiation emanating from the person in any of the fields of view is collected and focused upon a single sensing element to produce a cautionary signal representative of such detection. Plane mirrors are introduced in an optical reflection system of the detector to reflect the radiation from the reflector segments upon the sensing element, such as to reduce the spacing or dimension required for the optical system along the optical axis of the sensing element, whereby the detector is allowed to be made compact in size. Further, the optical system of the detector includes a device for selectively interrupting one or more paths between the respective reflector segments and the sensing element, such that the detector can receive the infrared radiation only from the selected or desired fields of view and ignore it from the undesired fields depending upon certain operating conditions, enhancing detection reliability.

10 Claims, 29 Drawing Figures

Vs1
VRO
Vs2

Vc1

Vc2
Vs3

Vc

VD

INFRARED-TYPE INTRUSION DETECTOR

BACKGROUND OF THE INVENTION

1. Field of the Invention

This invention is directed to an infrared intrusion detector, and more particularly to a passive infrared intrusion detector which provides a plurality of fields of view and detects the inherent infrared radiation emanating from a person passing through any of said fields of view.

2. Prior Art

There have been provided a wide variety of infrared detectors for monitoring the presence of a person or intruder entering in a room or space under surveillance to produce a signal representative of the detection. The most common type of such detector comprises at least one infrared sensing element and a plurality of concave reflector segments for providing separate fields of view to be monitored in the room or space. The concave reflector segments are arranged such that they collect and focus infrared radiation from the respective fields of view upon the sensing element for monitoring the presence of the person. To this end, the sensing element is designed to be located forwardly of the concave reflector segments for gathering the rays of infrared radiation once reflected by the reflector segments. In such a reflection system, the sensing element should be spaced forwardly of each reflection segment at a distance corresponding to each focal length from the corresponding reflector segment. Accordingly, the depth or thickness of a housing accommodating the sensing element and reflector segments must be large enough for covering such focal length, thus the depth or thickness of the housing cannot be reduced to beyond a certain limit. This has been the cause of a hindrance to obtain a more compact construction, particularly with respect to the thickness of the detector, which is highly desirable to be adapted in a restricted mounting space as well as which is desirable to be inconspicuous. With this arrangement, there also appears a problem that a wiring is required for connecting the sensing element in front of the reflector segments and electric components which are normally mounted on the backside of the detector and are cooperative with the sensing element to produce a cautionary signal representative of the infrared detection, such wiring detracting certainly from the neat arrangement of the detector and reducing design flexibility. In addition to the above, it is also desirable for such detectors having multi-spots detecting performance to kill the operation of one or more viewing fields in accordance with the actual condition of the room or space to be monitored by the detector. That is, problems are frequently seen in the case where one or more fields of view are occupied by such objects other than the human object that may emit infrared reradiation by being heated as by sunlight or other heat sources so as to mislead the detector, and in the case where one or more fields of view extend into unwanted regions which will only see passersby who have no intension of entering the space under surveillance. This occurs mostly when the detector is mounted for monitoring incoming or outgoing persons from the space such as a house or shop for the purpose of acknowledging the entrance into or exit from a supervised space. The prior art detectors, however, have been found not to have an easy access to selectively killing one or more fields of view depending upon the requirements of the room or space, and therefore are not to be satisfactory for the use in differing conditions.

SUMMARY OF THE INVENTION

The above disadvantages or shortcomings have been eliminated by the present invention which adopts a unique optical reflection system for an infrared-type intrusion detector. The optical reflection system in the present invention comprises a plurality of concave reflector segments arranged on the inner bottom surface of a housing of the detector for providing separate fields of view, a single infrared sensing element disposed on the side of said inner bottom surface with its optical axis extending fore and aft of the housing, and plane mirror means located forwardly of the reflector segments for collecting infrared radiation from the separate fields of view via the corresponding reflector segments and focusing it upon the sensing element. With this arrangment, the depth or thickness, required for the housing accommodating the optical system and determined substantially by the distance along the optical axis between the plane mirror means and the bottom of the housing, can be reduced to about one-half of the component on the optical axis of a maximum focal length among those of the reflector segments. Consequently, the housing for the detector utilizing the above optical reflection system can have a greatly reduced thickness or depth to be compact in size, particularly with respect to the lengthwise dimension along the optical axis of the sensing element, which enables the detector to be used in expanded application fields. Another advantageous feature associated with the above arrangement resides in that the sensing element disposed on the side of the inner bottom surface of the housing can be directly connected to electric components which are required to be mounted on the backside of the housing for not interrupting the incoming infrared radiation, thus, there is required no wiring which would be necessary for interconnecting the sensing element and the electric components as in the case where the sensing element is spaced forwardly of the reflector segments and would be the cause of greatly reduced design flexibility of the detector.

Accordingly, it is a primary object of the present invention to provide an infrared-type intrusion detector which is capable of being made compact in size as well as of insuring design flexibility.

A further advantageous feature of the present invention results from a unique and most useful structure associated with the optical reflection which includes means for selectively interrupting one or more paths between the respective concave reflector segments and the sensing element. In a preferred embodiment of the present invention, the plane mirror means is the assembly of plane mirrors each corresponding to each one of the concave reflector segments for reflecting the radiation therefrom upon the common sensing element. Each plane mirror is pivoted at its one end to a front cover of the housing so as to be movable between an operative position where it focuses the radiation reflected from the corresponding reflector segment upon the sensing element and an interrupting position where it fails to focus the radiation reflected from the corresponding reflector segment upon the sensing element. The plane mirrors thus being movable between the above two positions are combined with a corresponding number of switch knobs to constitute the interrupting means. That is, each knob is connected to each one of the plane mirrors so as to select the position thereof between the operative and interrupting positions. With the result of this, it is possible to selectively determine among a number of fields of view specified one to be supervised by the infrared detector as necessary to meet the differing requirements for different room spaces. This performance is most useful when one or more fields of view provided by the concave reflector segments fall within areas having infrared sources which are not aimed to be monitored by the detector, and therefore should be rendered inoperative while the rest remains operative to cover specified areas to be monitored for enhancing the reliability of the detector. In fact, objects other than the human body will emit reradiation when heated such as by sun light to cause a false detection, and accordingly should be eliminated from the objects monitored by the detector of this kind. Further, there are some case wherein mere passersby will cause unnecessary detection as occurs when the detector is installed at the entrance of a house or shop to be oriented outdoors. The present invention can provide a solution to the above problems by the arrangement capable of selecting the fields of view or receiving directions in accordance with actual installation requirements. In addition to the above, the switch knobs connected respectively to the pivoted plane mirrors facilitate the manipulation of changing the positions of the plane mirrors.

Consequently, it is another object of the present invention to provide an infrared-type intrusion detector which can selectively define the fields of view to be monitored depending upon the requirements on installation sites so as to be adapted in an extended application of uses, and which can effectuate an easy setting operation for selecting the fields of view.

The housing accommodating said optical reflection system is adapted to be installed by means of a mounting base on a ceiling, wall or the like members. To adjust the viewing directions or the fields of view determined by the arrangement of the reflection segments, the housing is pivotally supported by the mounting base so as to be movable about a pivot axis which is perpendicular to the optical axis of the sensing element. Preferably, the housing is also supported rotatably by the base so as to be rotatable about the optical axis of the sensing element for further adjustment of the detector.

It is a further object of the present invention to provide an infrared-type intrusion detector which is capable of being easily adjusted for accurate coincidence of the viewing fields with the desired areas to be monitored.

In the present invention, there is disclosed a still further useful feature in which two rows of the concave reflector segments are formed in the housing to provide the corresponding rows of viewing fields. These rows are disposed about a single infrared sensing element in such a way as to collect the infrared radiation from all of the viewing fields upon the sensing element, thus covering more fields of view with only one sensing element. This is advantageous in providing a compact and inexpensive structure having separate rows of concave reflector segments to cover more fields of view arranged in spaced rows.

These and other objects, advantages, features and uses will become more apparent from the following detailed description with reference to the attached drawings.

DETAILED DESCRIPTION OF THE INVENTION

Figure 1:
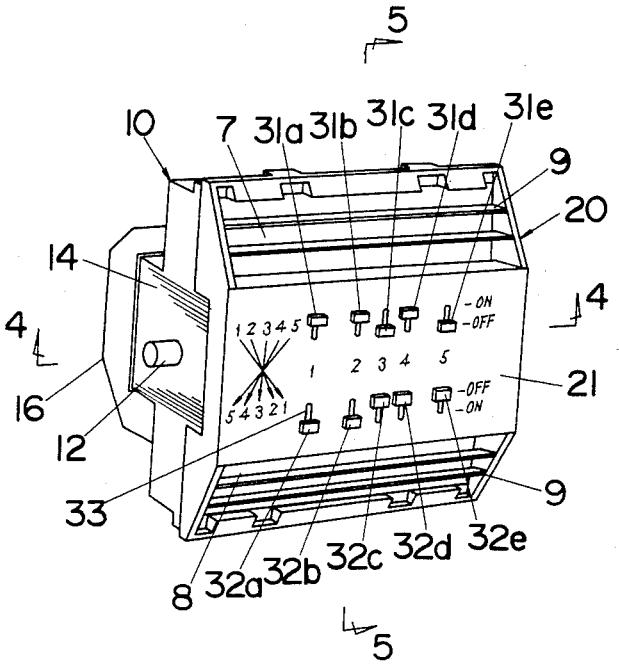
FIG. 1 is a perspective view of an infrared-type intrusion detector embodying the present invention.
Figure 2:
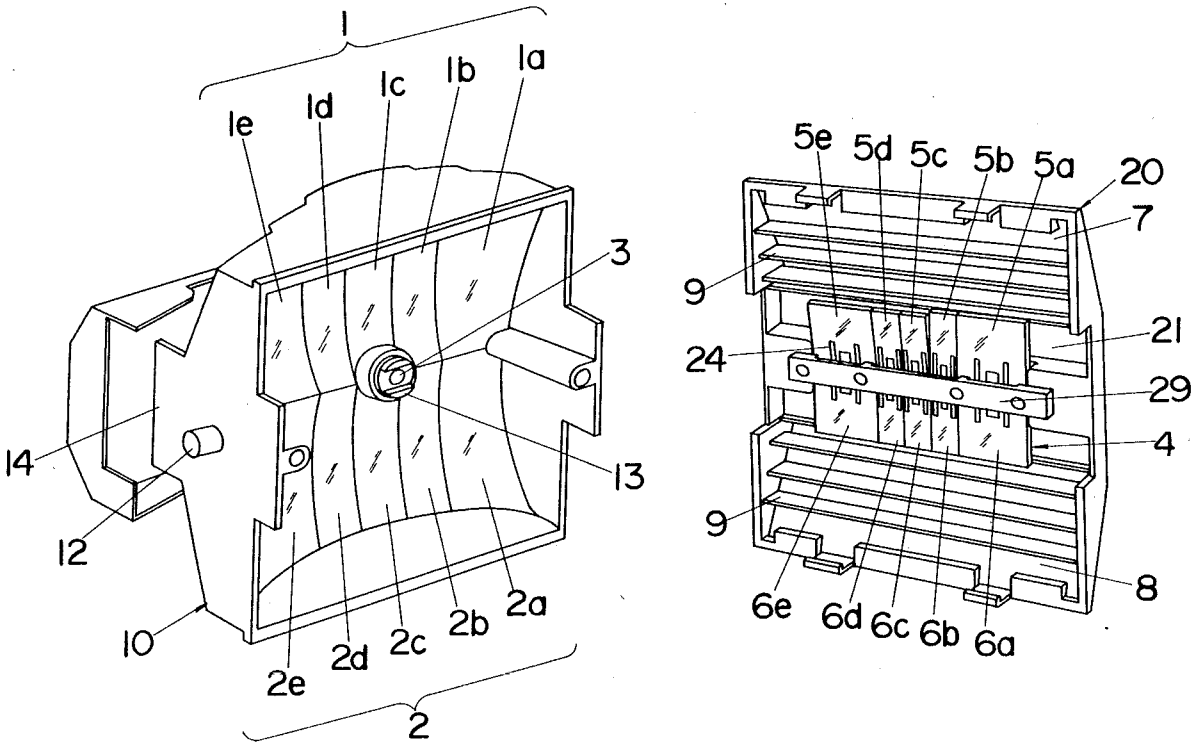
FIG. 2 is an exploded view of the above detector.
Figure 3:
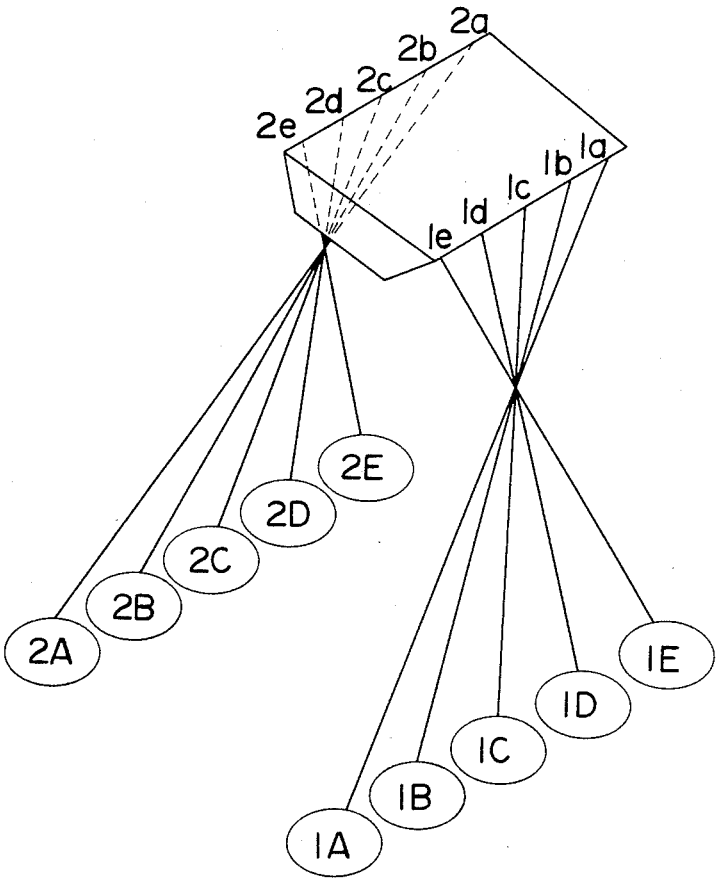
FIG. 3 is an explanatory view illustrating two rows of separate fields of view provided by the above detector.
Figure 4:
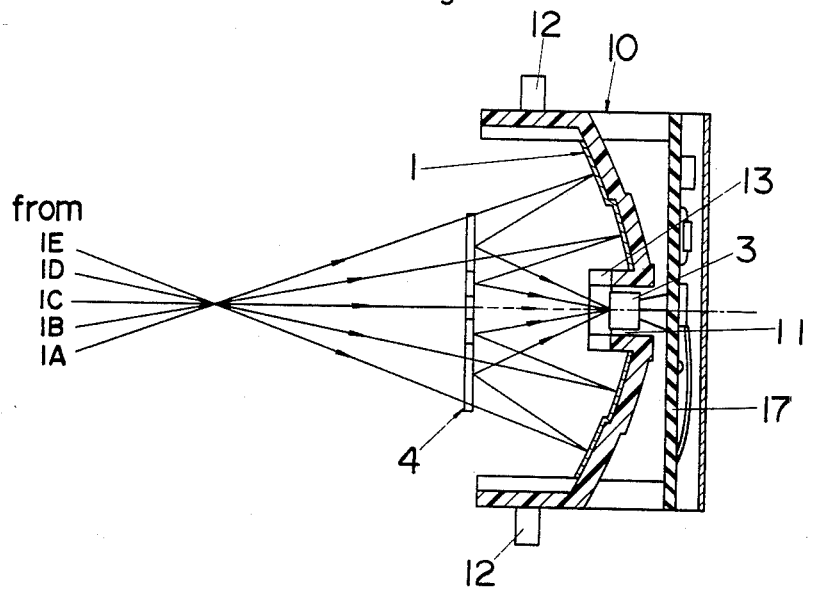
FIG. 4 is a cross sectional view taken along line 4—4 of FIG. 1 for illustrating the operation of the above detector.
Figure 5:
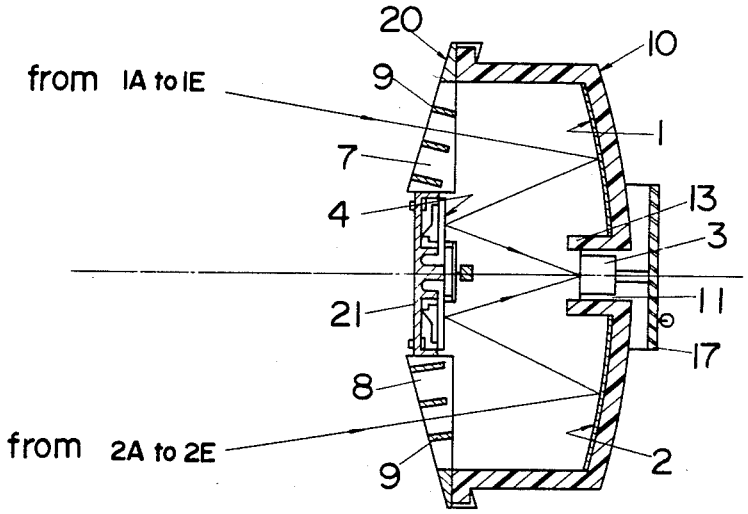
FIG. 5 is a cross sectional view taken along line 5—5 of FIG. 1 for illustrating the operation of the above detector.

Referring now to FIGS. 1 and 2, there is illustrated an infrared-type intrusion detector in accordance with a preferred embodiment of the present invention, which comprises a housing 10 accomodating an optical reflection system and a sensing element 3. The housing 10 has an inner bottom surface of generally concave configuration and a rectangular front open frame to which is adapted a front cover 20 with first and second openings 7 and 8 separated by a panel section 21. The sensing element 3 is received in a hole 11 located centrally of the inner bottom surface of the housing 10 with its optical axis perpendicular to the plane of said front open frame. Said optical reflection system includes plane mirror means 4 mounted on the back of the panel section 21 as well as first and second reflection rows 1 and 2 disposed on the respective halves of said inner bottom surface of the housing 10 in closely adjacent and parallel relationship with one another, the first row 1 being composed of five concave reflection segments 1*a* to 1*e* and the second row 2 composed of five concave reflector segments 2*a* to 2*e*. These concave reflector segments 1*a* to 1*e* and 2*a* to 2*e* are preferably double-curved parabolic mirrors to define the corresponding rows of separated fields of view or separate viewing directions to collect infrared radiation therefrom respectively through the first and second openings 7 and 8, each row having five separate fields of view 1A to 1E and 2A to 2E, and the rows being spaced in parallel relationship with one another, as best shown in FIG. 3. In this connection, said reflection segments 1*a*, 2*a* and 1*e*, 2*e* at both ends of each row have larger reflection areas than the middle three reflection segments 1*b* to 1*d* and 2*b* to 2*d*. The mirror surface of each reflection segments may be formed by providing chromium plating or aluminum evaporating on the inner bottom surface of the housing 10. Said plane mirror means 4 is incorporated to reflect the radiation once reflected from all the reflection segments and focusing it upon said sensing element 3, such that the infrared radiation from all of the fields of view are collected onto the sensing element 3, as in the manner illustrated in FIGS. 4 and 5. The thickness or depth required for the housing 10 is determined substantially by the length along the optical axis between the sensing element 3 and the plane mirror means 4, such length being apparently smaller than any of the components on the optical axis of the focal lengths of the respective reflection segments 1*a* to 1*e* and 2*a* to 2*e*, as is apparent from the same figures. Accordingly, the housing 10 can have a greatly reduced thickness than that adopting a reflection system without the plane mirror means. Each of said first and second openings 7 and 8 is in the form of a louver having parallel slats 9 so as to prevent the sensing element 3 from being directly impinged by infrared radiation emanating from other than said fields of view 1A to 1E and 2A to 2E. For the same purpose, there is provided on the inner bottom surface of the housing 10 a pair of vizors 13 projected forwardly of the sensing element 3 in diametrically opposed relationship about the optical axis. With this result, the sensing element 3 collects the radiation only from the fields of view and is free from unwanted detection or malfunction resulting from possible radiation emanating from the area other than the fields of view 1A to 1E and 2A to 2E defined respectively by the reflector segments 1*a* to 1*e* and 2*a* to 2*e*. Mounted on the back of the housing 10 is a printed circuit board 17 carrying a number of components forming an electric circuit which is coupled to the sensing element 3 for producing an output signal upon the detection of infrared radiation from any of said fields of view 1A to 1E and 2A to 2E. The printed circuit board 17 is supported by a pair of yokes 14 extending backwardly and integrally from the side of the housing 10 and is covered by a shield 16. Also integrally formed with the housing 10 are a pair of pivot pins 12 on both sides thereof for pivotally attaching the housing 10 to a base which is installed on the ceiling, wall, or the like of a room or space to be supervised by the detector, details of which will be described later.

Figure 6A:
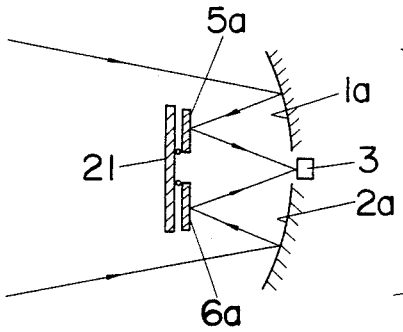
FIGS. 6A and 6B are respectively schematic views illustrating an operative position and an interrupting position of plane mirrors in the above detector.
Figure 6B:
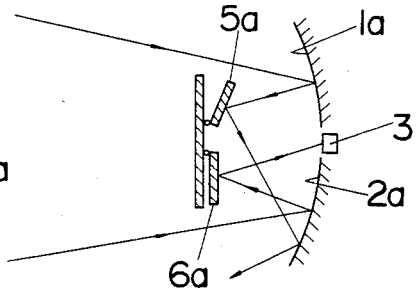
Figure 7A:
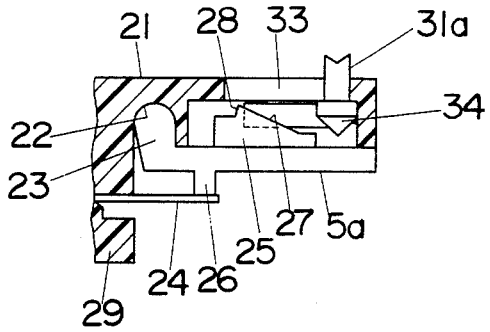
FIGS. 7A and 7B are respectively partial views illustrating the mechanism for moving the plane mirrors between the operative and interrupting positions.
Figure 7B:
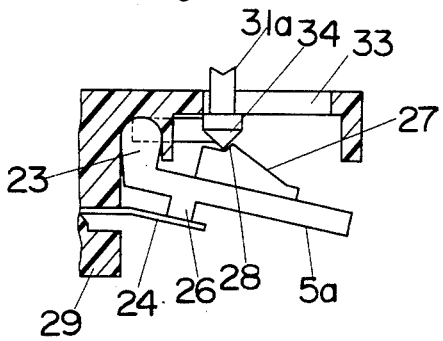
Figure 8:
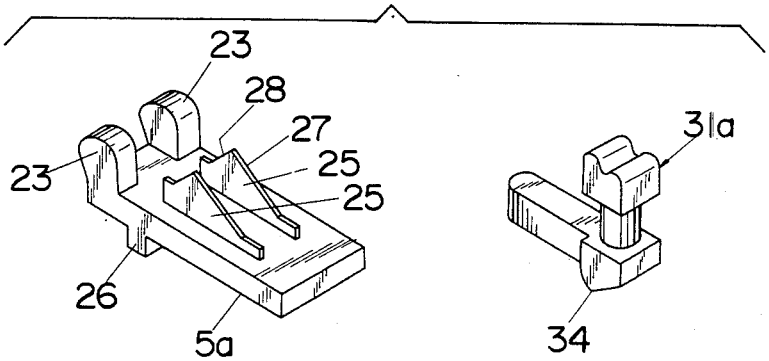
FIG. 8 is an exploded view of the plane mirror and a switch knob employed in the detector.

As best shown in FIG. 2, said plane mirror means 4 is divided into or composed of a corresponding number of plane mirrors 5*a* to 5*e* and 6*a* to 6*e* arranged in parallel rows, the plane mirrors on each row being pivotally held at its one end to said panel section 21 of the front cover 20 so as to be movable between two different angular positions about a common axis. One position is an operative position to successfully reflect the radiation coming from the fields of view and once reflected on the corresponding reflector segments upon the sensing element 3 as schematically shown in FIG. 6A, and the other is an interrupting position to deviate that radiation from the course toward the sensing element 3 and thus fail to collect the radiation onto the sensing element 3 as in FIG. 6B. This feature is most important when one or more fields of view should be withdrawn from the area to be monitored or supervised, the details of which will be explained later. The detailed structure for permitting each plane mirror to be movable between the operative and interrupting positions will be described with reference to FIGS. 7A, 7B and 8, in which one plane mirror 5*a* and associated parts therewith are only shown for representing the others. Each of plane mirrors 5*a* to 5*e* and 6*a* to 6*e* is in the form of a plate having a mirror surface provided by chromium plating or aluminum evaporation. Each mirror (5*a*) has at its one end a hinge portion 23 which is received in a recess 22 in the panel section 21 so as to be pivotally attached to the front cover 20 for permitting pivotal movement of the plane mirror (5*a*) between the above two positions. Projected onto the back surface of each mirror (5*a*) are a pair of cam members 25 each having an inclined edge 27. A cprresponding number of switch knobs 31*a* to 31*e* and 32*a* to 32*e* are provided for moving the plane mirrors 5*a* to 5*e* and 6*a* to 6*e* respectively between the above two positions, each being slidably held within the respective slots 33 in the panel section 21 of the front cover 20 and having a tip 34 which is engaged with said cam members 25 on each plane mirror (5*a*). Each of said plane mirrors is biased by a leaf spring 24, which is secured at its one end to the supporting bar 29 integral with the panel section 21, and is engaged with a protrusion 26 on one end of the corresponding plane mirror (5*a*) such that the leaf spring 24 retains the plane mirror (5*a*) in the operative position when the tip 34 of the switch knob 31*a* is slid to one end of the slot 33 to be disengaged with said cam members 25, as shown in FIG. 7A. When the switch knob 31*a* is slid to the opposite end of the slot 33, the tip 34 cams over the inclined edges 27 of the cam members 25 and retained behind shoulders 28 in which position the plane mirror 5*a* is held in the interrupting position against the biasing force of the leaf spring 24, as shown in FIG. 7B. In this manner, all the plane mirrors 5*a* to 5*e* and 6*a* to 6*e* can be easily manipulated by the corresponding switch knobs 31*a* to 31*e* and 32*a* to 32*b* to be placed in one of the above two positions depending upon the actual operating conditions of different rooms or spaces to be monitored by the detector.

Figure 9:
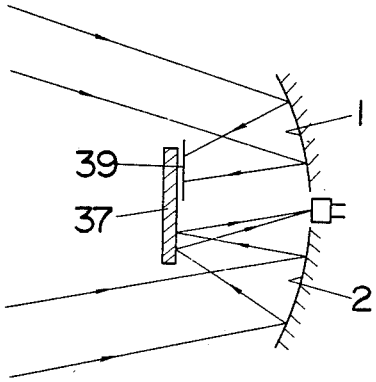
FIG. 9 is a schematic view of a modification of the above embodiment.
Figure 10:
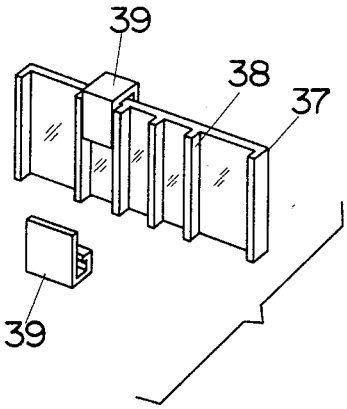
FIG. 10 is a perspective view of a plane mirror and screens employed in the modification of FIG. 9.

FIGS. 9 and 10 illustrate an alternative arrangement of plane mirror means 37 which may be employed in the present invention in which a number of screen members 39 are utilized for interrupting the radiation toward the sensing element. The plane mirror means 37 is an integral mirror divided into five plane mirror segments by guide ribs 38. Each screen member 39 is slidably fitted to the portion between the adjacent ribs 38 to cover the corresponding mirror segments, interrupting the function of reflecting the radiation upon the sensing element.

Figure 11:
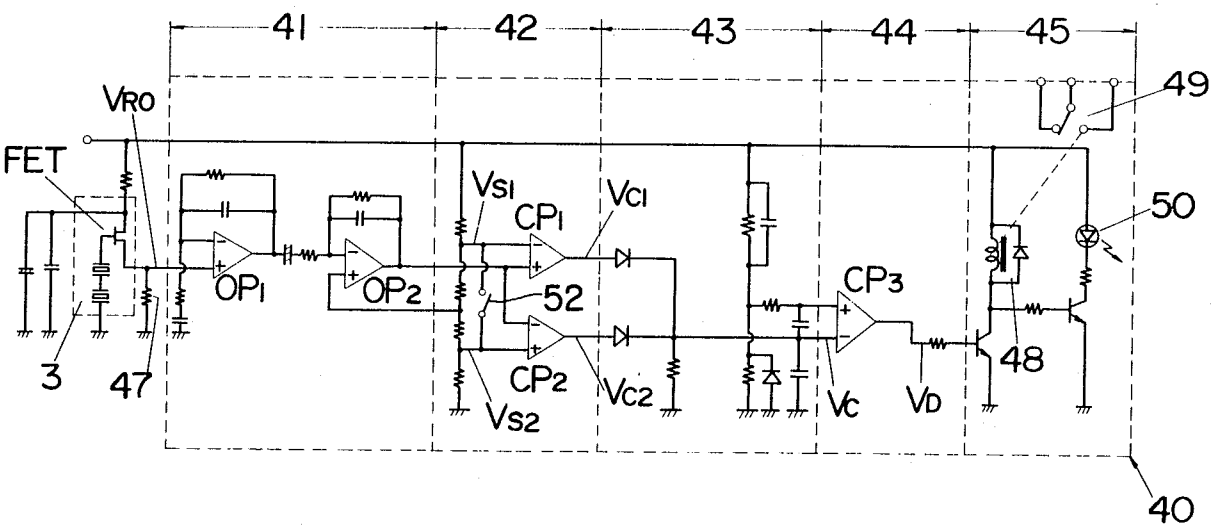
FIG. 11 is a circuit diagram of a signal processing circuit employed in the above detector.
Figures 12A, 12B, 12C, 12D, 12E:
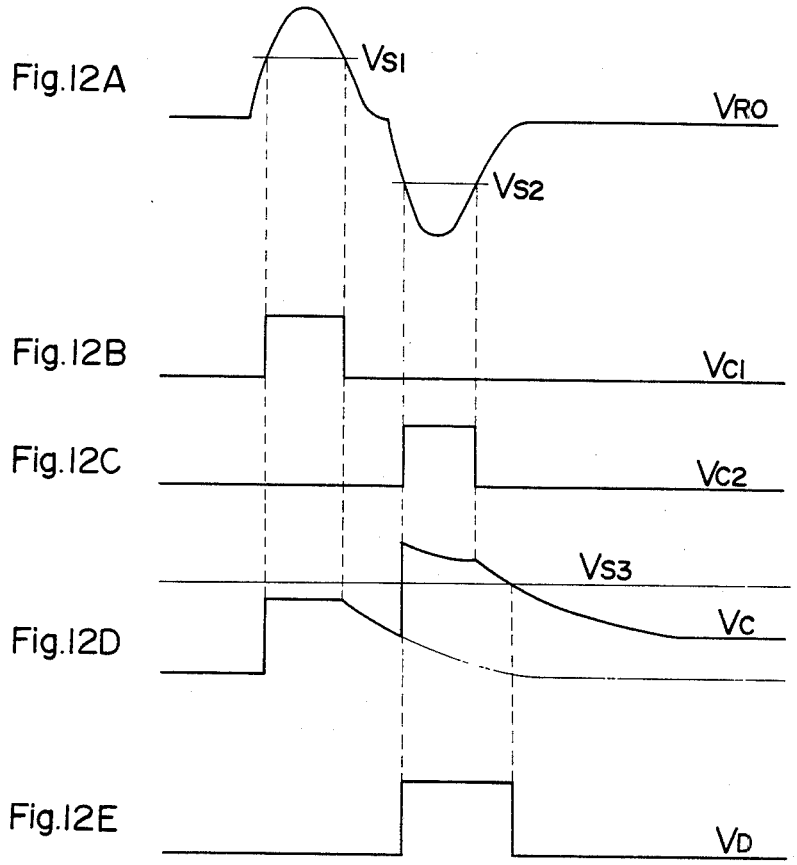
FIGS. 12A, 12B, 12C, 12D and 12E are respectively wave form charts illustrating the operation of the detection circuit of FIG. 11.

Referring to FIG. 11, there is illustrated a signal processing circuit 40 which is coupled to the circuit on said printed circuit board 17 on the back of the housing 10 for providing a cautionary signal representative of the infrared detection by the sensing element 3. The circuit 40 comprises an amplifier section 41, a level detector section 42, a wave-shaping section 43, a discriminator section 44 and an output section 45. The operation of the circuit 40 will follow in conjunction with FIGS. 12A to 12E in which wave forms at several portions in the circuit are shown. Said sensing element 3 which is composed of pyroelectric crystals is coupled to FET to provide an amplified output voltage $V_{R0}$ across a resistor 47. Such output voltage $V_{R0}$ will vary while a person passes through any of said fields of view in such a manner that, as indicated in FIG. 12A, it becomes positive at the time of the person entering the fields of view and becomes negative at the time of leaving that field. The resulting output voltage $V_{R0}$ is further amplified by a pair of operational amplifiers $OP_1$ and $OP_2$ in the amplifier section 41 and is thereafter fed to the level detector section 42 which includes a pair of comparators $CP_1$ and $CP_2$, one for producing an output pulse $V_{C1}$ when the output level from the amplifier section 41 exceeds the amplitude of $V_{S1}$ and the other for producing an output pulse $V_{C2}$ when that level falls below the amplitude of $V_{S2}$, as respectively indicated in FIGS. 12B and 12C. The output pulses $V_{C1}$ and $V_{C2}$ are combined in the wave-shaping section 43 to provide a combined signal $V_C$ of FIG. 12D to the discriminator section 44 in which a comparator $CP_3$ operates to produce a signal $V_D$ when the level of the above combined signal exceeds a reference voltage of $V_{S3}$, as indicated in FIG. 12E. It is this signal $V_D$ that serves as said cautionary signal representative of the infrared detection by the sensing element 3 to drive a relay 48 in the output section 45. In response to the signal $V_D$, the relay 48 actuates to close a contact 49 for connecting a load which may be a buzzer or the like alarming means for notifying the presence or entrance of the person in any of said fields of view. The numeral 50 designates an indicator lamp which is a light emitting diode to be turned off simultaneously at the time of connecting the load. In this connection, a voice synthesizer may be employed as the load so as to speak a welcoming message to the person or visitor entering the fields of view under surveillance. Included in said level detector section 42 is a selection switch 52 to adjust the respective reference voltage levels $V_{S1}$ and $V_{S2}$ of the comparators $CP_1$ and $CP_2$ and operates to set a smaller amplitude for each reference voltage when a protective covering is adapted to cover the detector. Such protective covering, which will be seen in the subsequent description should be of course translucent to infrared radiation but will certainly decrease the amount of infrared radiation collected on the sensing element 3. By this reason, the above selection switch 52 is incorporated in the circuit for maintaining efficacy of the detector irrespective of the covering being adapted or not. The selection switch 52 is preferably a reed switch which is activated by a permanent magnet fixed to the covering so as to provide a smaller amplitude to each of said reference voltages for compensating the decrease in the amount of incoming infrared radiation. Further, a timer circuit can be included in the circuit when the relay 48 is selected to be of ratch-in type so as to be cooperative therewith for providing after a predetermined time interval a reset signal to disconnect the load which has been already connected in response to said signal $V_D$.

Figure 13A:
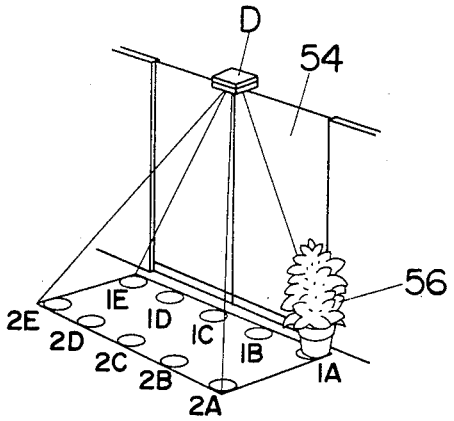
FIGS. 13A, 13B and 13C are explanatory views respectively illustrating examples of use in different operating conditions.
Figure 13B:
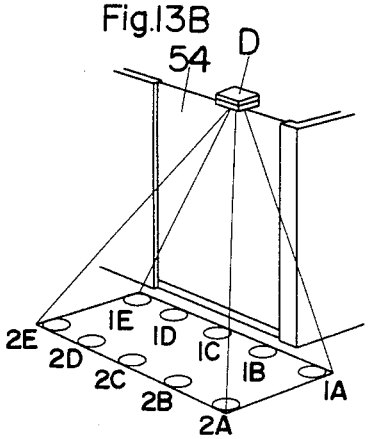
Figure 13C:
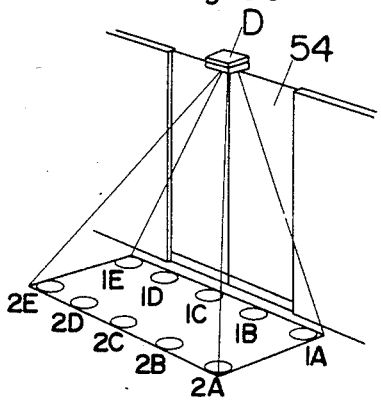

Now referring to FIGS. 13A to 13C, there are shown some operating conditions which are frequently seen in the use of the detector. In these figures, the use of the detector for monitoring the area outside of a door is presented for easily understanding the operation of the detector, however, it should be noted that the same can be applicable for other uses of the detector as installed for monitoring an indoor space and the like. The detector D, in this instance, is located above the door 54 to provide a total of ten fields of view 1A to 1E and 2A to 2E separated with each other in the area in front of the door 54 such that it can detect an incoming person through the door. It is to be noted at this time, the detector D is required so as not to detect mere passersby as well as objects other than humans that may emit infrared reradiation by being heated by sun light which could mislead the detector D. FIG. 13A shows one condition in which all the fields of view are located substantially within the width of the door 54 or the entrance opening in such a way as to detect the incoming person but in which one field of view 1A is occupied by a potted plant 56 which will be the source of infrared reradiation to mislead the detector D and therefore should be required not to activate the detector D. To eliminate the influence of said plant 56, the corresponding plane mirror 5*a* is switched to the interrupting position by the manipulation of the corresponding switch knob 31*a* so as to deviate the radiation from such plant 56 from the course toward the sensing element, while the other plane mirrors remain in the operative position to collect the radiation from the fields of view other than 1A successfully upon the sensing element. FIG. 13B shows another condition in which the area covered by said fields of view extends beyond the width of the door 54 such that the fields of view 1A and 2A correspond to a common area through which mere passersby will pass. Therefore, in this condition, the corresponding plane mirrors 5*a* and 6*a* are switched to the interrupting position while the others remain in the operative position for detecting only the incoming person and ignoring the passersby. In FIG. 13C, the condition is such that 1A, 1E, 2A and 2E are out of confrontation with the door 54 to be unnecessary for the detection of the incoming person, or be preferably ignored in view of that these fields may be the cause of misleading the detector D as in the case where the fields are occupied by a signboard or other objects similar to said potted plant 56 of reradiation source. For this reason, the corresponding plane mirrors 5*a*, 5*e*, 6*a* and 6*e* are respectively switched to the interrupting position while the others remain in the operative position. With this arrangement capable of selectively rendering one or more fields of view inoperative, the detector D can be utilized in a wide variety of the operating conditions.

Figure 14:
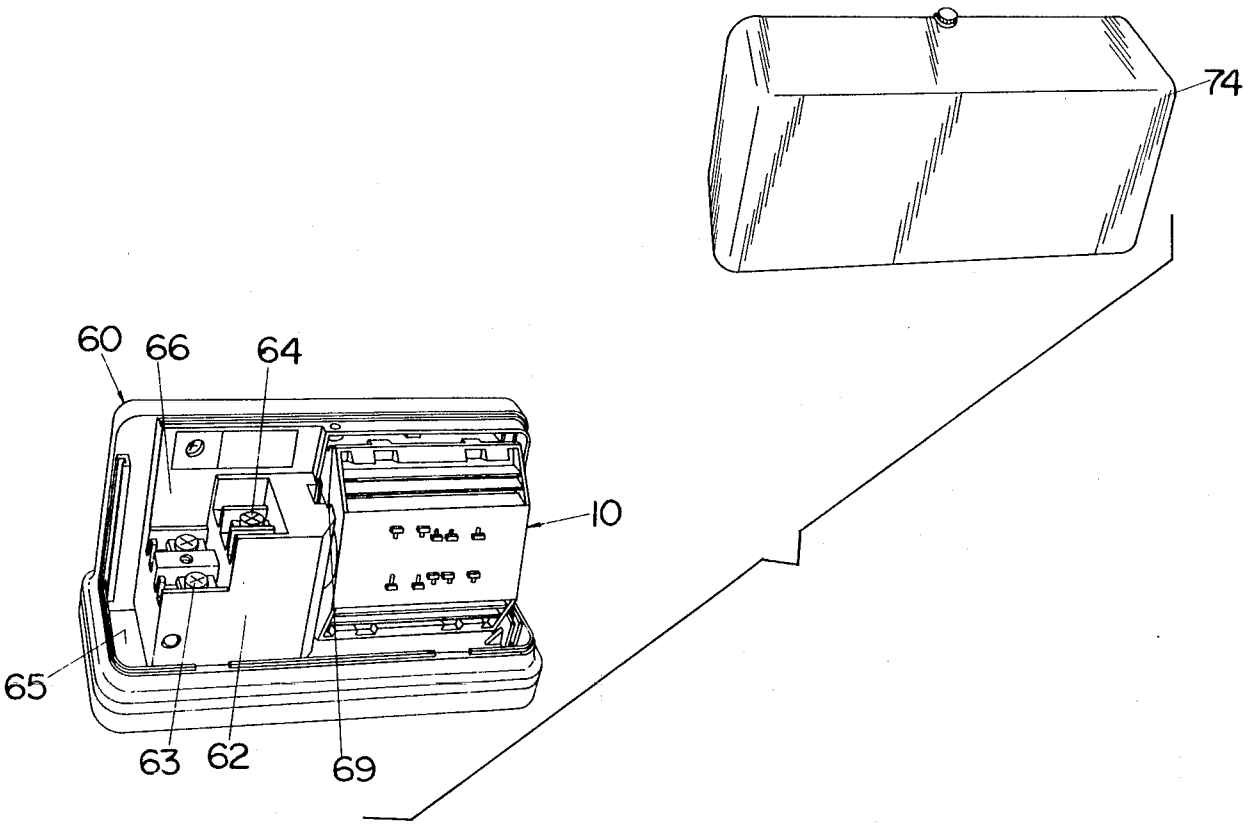
FIG. 14 is a perspective view of the above detector received in a mounting base.
Figure 15:
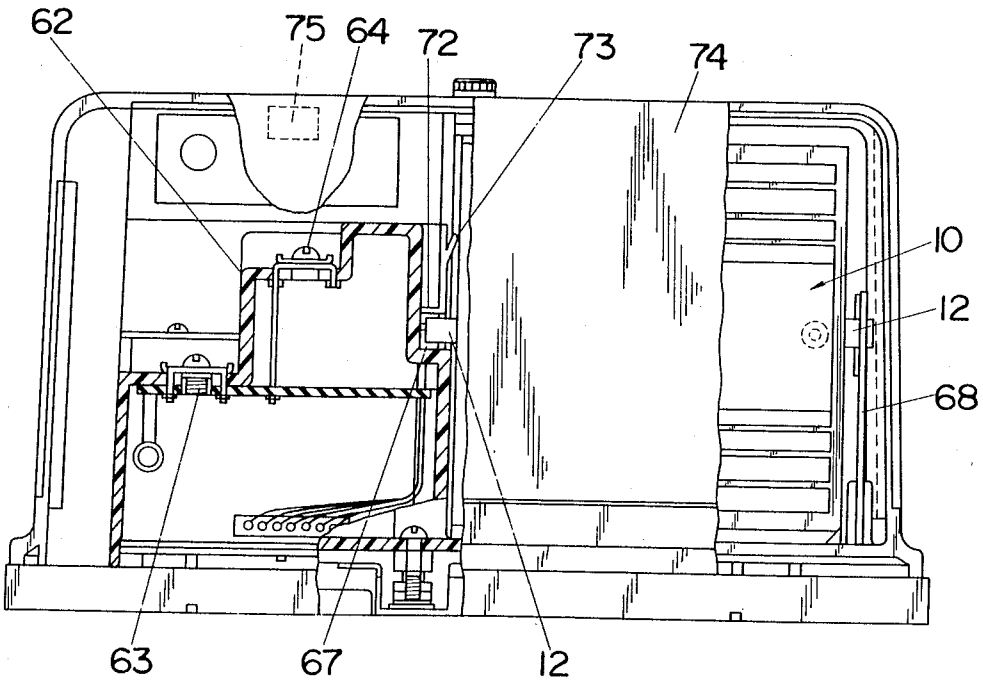
FIG. 15 is a sectional and partly broken away view of the mounting base of FIG. 14.
Figure 17:
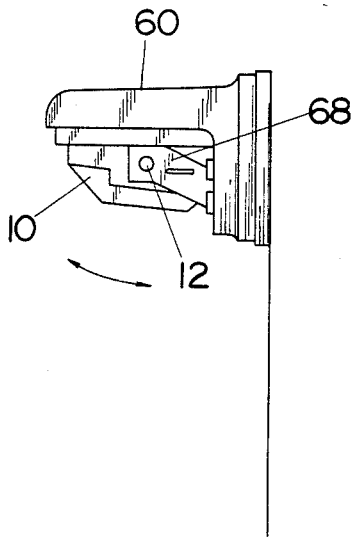
FIG. 17 is a schematic view illustrating the use of the above detector in the mounting base of FIG. 14.
Figure 16:
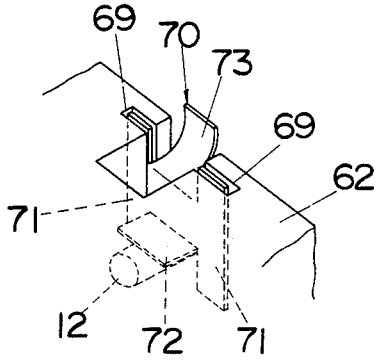
FIG. 16 is a partial view in perspective of a holder plate for holding the detector at desired angular position with respect to the above mounting base.

Referring to FIGS. 14 to 16, there is illustrated one example of a mounting base 60 accommodating the above detector adapted to be installed on the wall or ceiling enclosing the space to be monitored by the detector. The mounting base 60 is provided with a terminal block 62 adjacent to the space for receiving the housing 10 of the detector. The terminal block 62 has an input terminal 63 to be connected to a line voltage for operating the detector and an output terminal 64 to be connected to the load such as the buzzer or the like alarming means as previously described. The connection lines from the input and output terminals are extended outwardly through a bottom opening 65 to the base 60. Disposed within a rear wall 66 of the base 60 is a printed circuit board (not shown) mounting a number of components to form said signal processing circuit of FIG. 11. Said indicator lamp 50 is mounted on the rear wall 66. The housing 10 of the detector is pivotally received in the base 60 by means of said pivot pins 12 so as to pivot about a common pivot axis of the pivot pins 12 within a limited angular range, permitting the adjustment of the directions of said first and second openings 7 and 8, i.e., the viewing directions of the detector. One pivot pin 12 is journaled in a recess 67 formed in one side of said terminal block 62 and the other pin 12 in a hole of an upright support 68 secured at the opposite side end of the base 60. Secured to the terminal block 62 is a holder plate 70 for retaining the housing 10 in suitable angular positions about the pivot axis. As shown in FIG. 16, the holder plate 70 is secured to the terminal block 62 with its lateral legs 71 being tightly inserted in respective grooves 69 in the block 62. Also formed in the holder plate 70 are a lower tongue 72 and an upper tongue 73, the lower tongue 72 abutting on the periphery of the pivot pin 12 for rotatably holding the same in said recess 67. The upper tongue 73 is curved so as to be resiliently urged at its upper end against the side wall of the housing 10 about the pivot pin 12. The abutting surface of the upper tongue 73 is provided with a number of teeth (not shown) for providing clicking movement during the adjustment of the angular position of the housing 10 of the detector. FIG. 17 shows a typical use of the detector thus received in the mounting base 60. In this instance, the mounting base is fixed to the wall of a space to be supervised and the housing 10 pivots about a horizontal pivot axis to adjust its viewing directions or said fields of view so as to meet the requirement of the space. The protective covering 74 may be adapted to cover the detector and the terminal block 62 for preventing the entry of dust or other harmful foreign matter. The covering 74 is made of suitable material translucent to infrared radiation and of less infrared absorption. Attached in the interior of the covering 74 is the permanent magnet 75 to activate the selection switch 52 which is the reed switch included in said signal processing circuit for compensating the decrease in the amount of infrared radiation from the fields of view when using the covering 74, as previously described.

Figure 18:
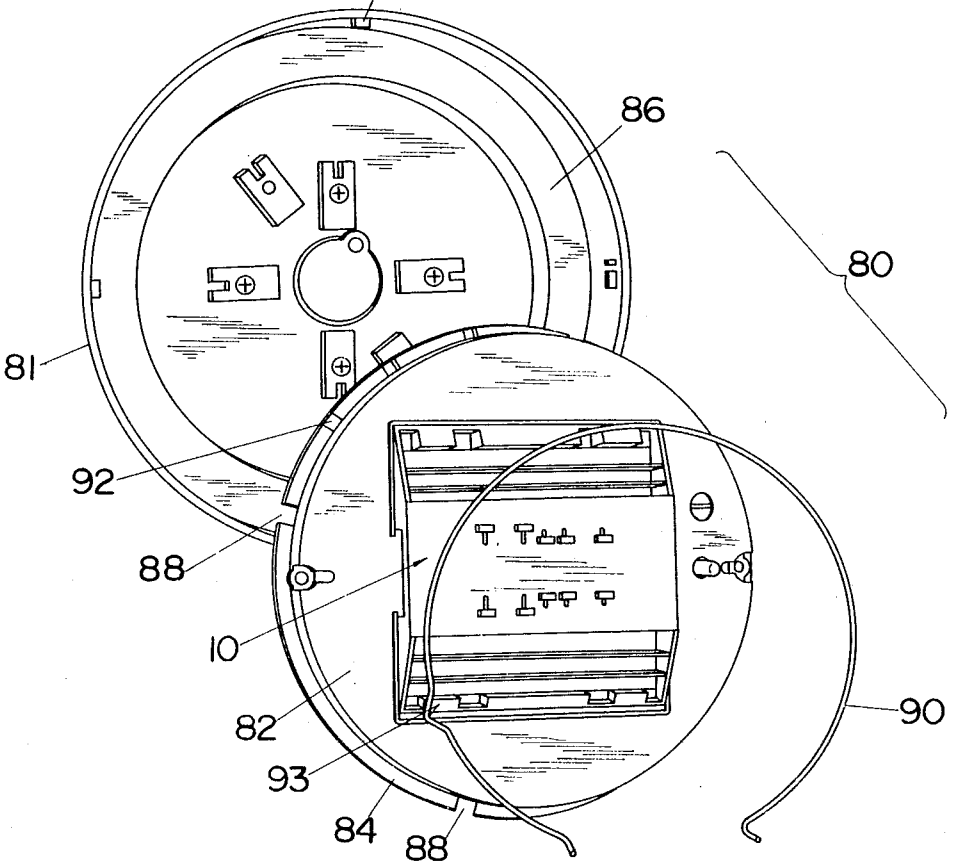
FIG. 18 is an exploded view in perspective of showing the detector in an alternative mounting base which is adapted to be installed on a ceiling.
Figure 19:
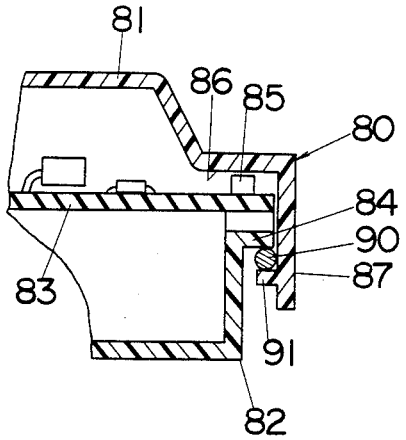
FIG. 19 is a partial sectional view illustrating the internal structure of the mounting base of FIG. 18.
Figure 20:
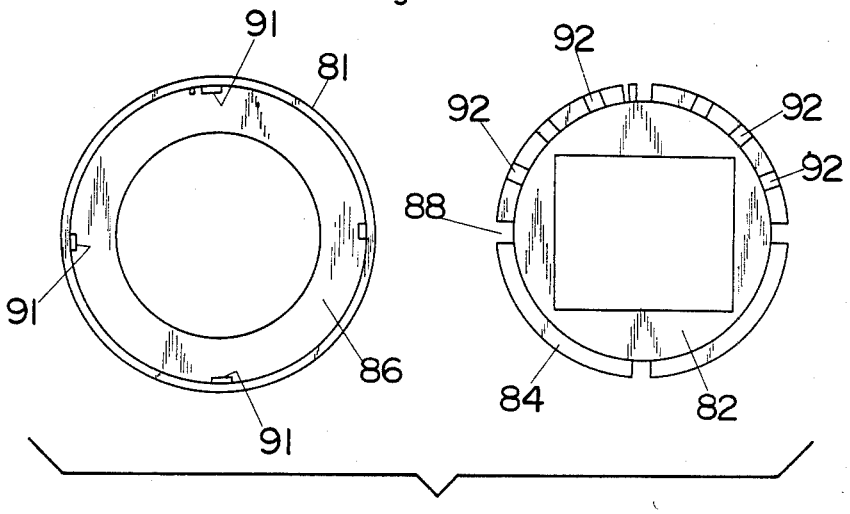
FIG. 20 is an exploded view in schematic representation of the mounting base of FIG. 18.
Figure 21:
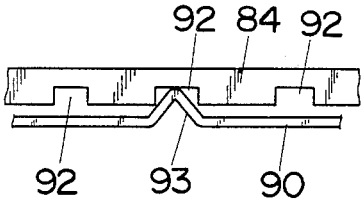
FIG. 21 is a partial view explaining the clicking mechanism employed in the mounting base of FIG. 18.

An alternative example of a mounting base 80 for accommodating the detector is shown in FIG. 18. The mounting base 80 is designed to be connected directly to an electric outlet mounted on the ceiling of a room, and is composed of a casing 81 with terminals (not shown) on the upper surface for the connection with the outlet and an inner disk 82 carrying the housing 10 of the detector. The housing 10 is received centrally of the disk 82 with the pivot pins 12 being journaled thereby for being permitted the pivotal movement about a pivot axis within the plane of the disk 82, which is in turn rotatably received within the casing 81 so as to be rotatable about a center axis perpendicular to the plane of the disk 82. A printed circuit board 83 forming said signal processing circuit is mounted on the back or upper surface of the disk 82, as shown in FIG. 19. Extended around the periphery of the disk 82 is a flange 84 having on its upper surface circumferentially spaced studs 85 which extend through the printed circuit board 83 to be slidably engaged with a raised rim 86 formed inwardly of a side wall 87 of the casing 81, thus permitting the above rotational movement of the disk 82 within the casing 81. A retaining ring 90 is inserted between the flange 84 and the confronting projections 91 on the inner surface of said side wall 87 to retain the disk 82 within the casing 81 while permitting the rotational movement thereof. Said flange 84 is provided with a corresponding number of circumferentially spaced cutouts 88 through which said projections 91 can pass at the time of assembling the disk 82 into the casing 81, as best shown in FIG. 20. The flange 84 is also provided in its lower surface with a plurality of circumferentially spaced recesses 92 into one of which a V-shaped portion 93 of said retaining ring 90 is snapped during the rotational adjustment of the disk 82 within the casing 81. Thus, the disk 82 is retained by the above snapping action in position for effectuating stable rotational adjustment of the disk 82 about the center axis of the mounting base 80. In this instance, the housing 10 of the detector is received in the mounting base 80 with the optical axis of the sensing element being in coincidence with the center axis of the base 80, such that the housing 10 of the detector can be rotatively adjusted about the optical axis in addition to being adjustable about the pivot axis which is perpendicular to the optical axis. This enables the detector to have an increased adjustability in designating said viewing directions or the fields of view to the specified spots in a room or space to be monitored by that detector. A protective cover of the same kind as previously described can be of course adapted to the mounting base 80.

The above description and particularly the drawings are set forth for purposes of illustration only. It will be understood that many variations and modifications of the above embodiment and examples herein described will be obvious to those skilled in the art without departing from the spirit and scope of the invention.

We claim:

1. An infrared-type intrusion detector comprising:

a housing with at least one front opening and an inner bottom surface;

a single infrared sensing element disposed on the side of said inner bottom surface with its optical axis extending fore and aft of the housing;

a plurality of concave reflector segments disposed on the bottom surface of the housing for providing separate fields of view and collecting infrared radiation therefrom through said front opening;

plane mirror means disposed forwardly of the concave reflector segments within the housings for reflecting said infrared radiation once reflected from said concave reflector segments and focusing it upon said infrared sensing element;

electrical circuit means responding to the infrared detection by the sensing element to produce a cautionary signal; and means for selectively interrupting one or more paths between the respective concave reflector segments and the sensing element, said means for selectively interrupting comprises an assembly of plane mirrors defining said plane mirror means, each plane mirror corresponding to each one of said concave reflector segments and being pivoted at its one end to a front cover of the housing so as to be movable between an operative position where it focuses the infrared radiation reflected from the corresponding concave reflector segment upon the sensing element and an interrupting position where it fails to focus the infrared radiation reflected from the corresponding concave reflector segment upon the sensing element.

2. An infrared-type intrusion detector as set forth in claim 1, wherein said front opening is provided with a louver for preventing the entrance of the rays of infrared radiation from the area other than said fields of view into the sensing element.

3. An infrared-type intrusion detector as set forth in claim 1, wherein said interrupting means further comprises a corresponding number of switch knobs, each of said switch knobs being connected to one of the plane mirrors to select the position thereof between said operation and interrupting positions.

4. An infrared-type intrusion detector as set forth in claim 1, further including a mounting base to which said housing is pivotally supported such that said housing can pivot about a pivot axis perpendicular to the optical axis of the sensing element and can be held at desired angular positions about that axis.

5. An infrared-type intrusion detector as set forth in claim 4, wherein said housing is further rotatably supported by said base about the optical axis such that it can be held at desired angular positions both about the pivot axis and the optical axis.

6. An infrared-type intrusion detector comprising:

a housing with first and second front openings orientated in different directions with each other and with inner bottom surface;

a single infrared sensing element disposed on the side of said inner bottom surface of the housing with its optical axis extending fore and aft of the housing;

a first reflecting row composed of a plurality of concave reflector segments disposed on the bottom surface of the housing in a row for providing first group of separate fields of view and collecting infrared radiation therefrom through said first opening;

a second reflecting row which is parallel to the first row and composed of a plurality of concave reflector segments disposed on the inner bottom surface of the housing in a row providing second group of separate fields of view and collecting infrared radiation therefrom through said second opening;

plane mirror means disposed forwardly of the concave reflector segments for reflecting the infrared radiation from each of said concave reflector segments upon said infrared sensing element, said plane mirror means comprising an assembly of a number of plane mirrors arranged in first and second rows, each plane mirror corresponding to one of said concave reflector segment and being pivoted at its one end to a front cover of the housing so as to be movable between an operative position where it focuses the infrared radiation reflected from the corresponding concave reflecting segment upon the sensing element and an interrupting position where it fails to focus the infrared radiation reflected from the corresponding concave reflector segment upon the sensing element; and electrical circuit means responding to the infrared detection by the sensing element to produce a cautionary signal, said first and second rows of concave reflector segments being arranged on both sides of the sensing element.

7. An infrared-type intrusion detector as set forth in claim 6, wherein said plane mirror means further comprises a corresponding number of switch knobs each connected to one of the plane mirrors so as to select the position thereof between said operation and interrupting positions.

8. A infrared-type intrusion detector as set forth in claim 6, wherein said first and second front openings are provided respectively with louvers for preventing the entrance of the rays of infrared radiation from the area other than said fields of view into the sensing element.

9. An infrared-type intrusion detector as set forth in claim 6, further including a mounting base to which said housing is pivotally supported such that said housing can pivot about a pivot axis perpendicular to the optical axis of the sensing element and can be held at desired angular positions about the axis.

10. An infrared-type intrusion detector as set forth in claim 9, wherein said housing is further rotatably supported by said base about the optical axis such that it can be held at desired angular positions both about the pivot axis and the optical axis.

* * * * *